US007954480B2

(12) United States Patent
Broberg, Jr.

(10) Patent No.: US 7,954,480 B2
(45) Date of Patent: Jun. 7, 2011

(54) PELLET GUN FEEDER

(75) Inventor: Dewey O. Broberg, Jr., Colony Beach, FL (US)

(73) Assignee: Du-Bro Products, Inc., Wauconda, IL (US)

( * ) Notice: Subject to any disclaimer, the term of this patent is extended or adjusted under 35 U.S.C. 154(b) by 498 days.

(21) Appl. No.: 12/102,338

(22) Filed: Apr. 14, 2008

(65) Prior Publication Data

US 2009/0255522 A1 Oct. 15, 2009

(51) Int. Cl.
*F41B 11/02* (2006.01)

(52) U.S. Cl. ..... 124/45; 221/267; 221/279

(58) Field of Classification Search ..... 124/45, 124/50, 51.1; 221/279, 226, 267; 604/62, 604/64

See application file for complete search history.

(56) References Cited

U.S. PATENT DOCUMENTS

| | | | | | |
|---|---|---|---|---|---|
| 803,389 | A | * | 10/1905 | Bernard | 42/17 |
| 926,546 | A | * | 6/1909 | Cox | 124/48 |
| 2,294,001 | A | * | 8/1942 | Ritter | 206/537 |
| 2,601,852 | A | * | 7/1952 | Wendt | 604/59 |
| 3,236,521 | A | * | 2/1966 | Knott | 473/457 |
| 3,263,664 | A | * | 8/1966 | Bauer et al. | 124/49 |
| 3,558,007 | A | * | 1/1971 | Seghezzi et al. | 221/232 |
| 3,669,310 | A | * | 6/1972 | Zackheim | 221/279 |
| 3,688,957 | A | * | 9/1972 | Beddoe et al. | 226/7 |
| 3,934,584 | A | * | 1/1976 | Corio | 604/59 |
| 4,020,974 | A | * | 5/1977 | Bauer et al. | 221/307 |
| 4,060,083 | A | * | 11/1977 | Hanson | 604/59 |
| 4,113,143 | A | * | 9/1978 | Spagnola, Jr. | 221/267 |
| 4,173,211 | A | * | 11/1979 | Crawford, Jr. | 124/45 |
| 4,831,998 | A | * | 5/1989 | Maguire, III | 124/50 |
| 4,993,400 | A | * | 2/1991 | Fitzwater | 124/48 |
| 5,150,701 | A | * | 9/1992 | Wackrow et al. | 124/67 |
| 2007/0181029 | A1 | * | 8/2007 | Mcaninch | 102/430 |

* cited by examiner

*Primary Examiner* — John Ricci
(74) *Attorney, Agent, or Firm* — Mathew R.P. Perrone, Jr.; Brie A. Crawford

(57) ABSTRACT

A pellet gun feeder aligns at least one pellet with the breech of a pellet gun, such as a pellet pistol or a pellet rifle, and places at least one pellet in the pellet gun for use or to be discharged therefrom.

18 Claims, 5 Drawing Sheets

*Fig.* 12
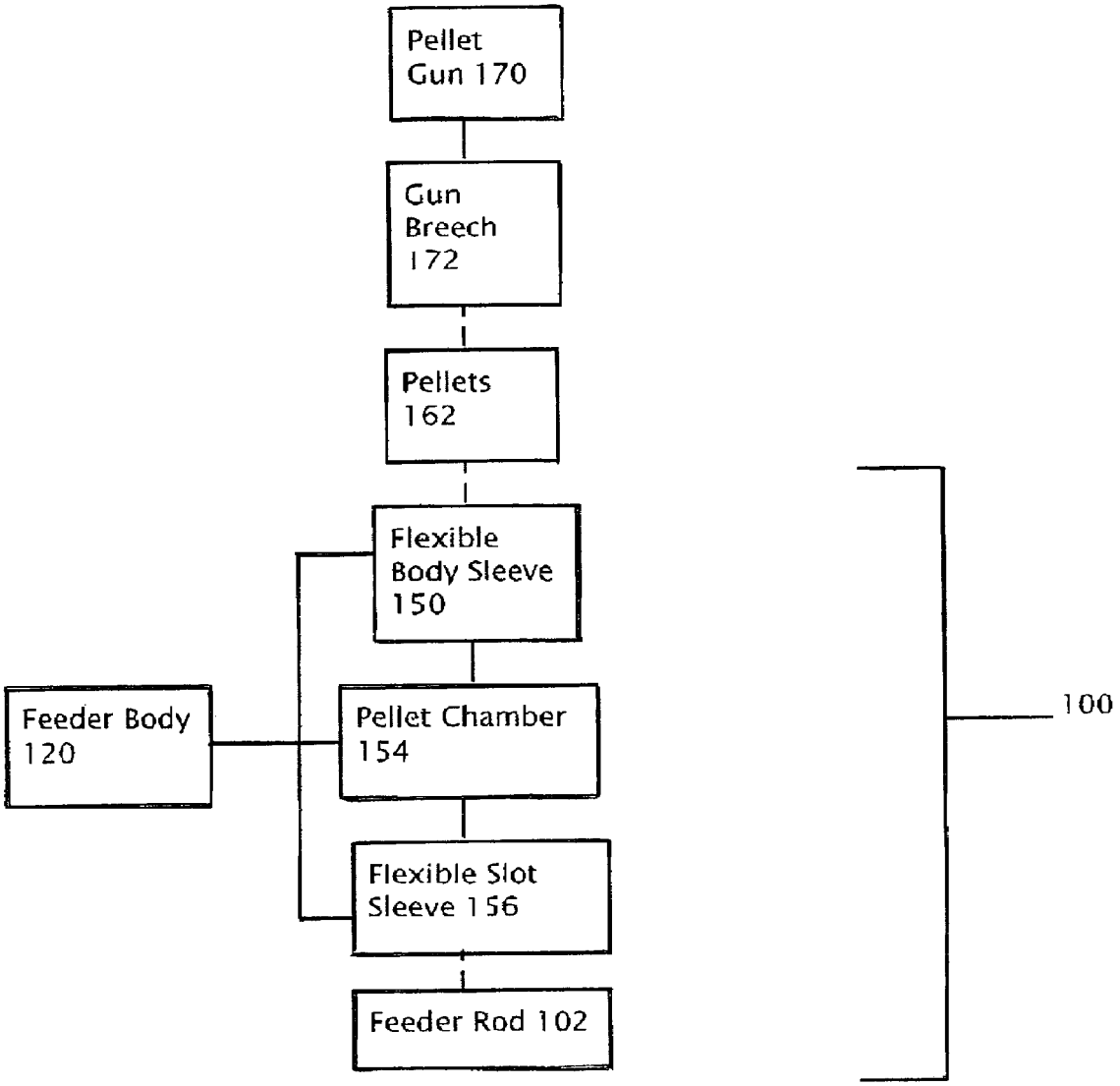

PELLET GUN FEEDER

This invention relates to a gun feeder and more particularly to a pellet gun feeder for use in loading pellets in a pellet gun so that the pellets may be properly positioned.

BACKGROUND OF THE INVENTION

A pellet gun is powered by compressed air and discharges a projectile from the barrel of a pistol pellet gun or a rifle pellet gun by a trigger activating a source of compressed air to force the pellet down the barrel, out of the barrel and at a target. The target may be a practice target in the form of paper or a solid target. The target may also be an actual target when the pellet gun is used for pest control.

A number of pellet guns are single shot guns, which guns are breech loaded with one pellet at a time. Since the pellets can be awkward to handle and load, selecting a single pellet from a group of pellets to load into the pistol pellet gun or the rifle pellet gun can be difficult. A device to simplify such a loading procedure can provide great advantages.

SUMMARY OF THE INVENTION

Among the many objectives of the present invention is the provision of a pellet gun feeder for loading a pellet into a breech loading pellet gun.

Another objective of the present invention is the provision of a pellet gun feeder, to organize pellets for loading into a pellet gun.

These system and other objectives of the invention (which other objectives become clear by consideration of the specification, claims and drawings as a whole) are met by providing a pellet gun feeder which aligns at least one pellet with the breech of a pellet gun, such as a pellet pistol or a pellet rifle, and places at least one pellet in the pellet gun for use.

BRIEF DESCRIPTION OF THE DRAWINGS

FIG. 12 depicts a block diagram of pellet gun feeder 100.

Throughout the figures of the drawings, where the same part appears in more than one figure of the drawings, the same number is applied thereto.

DESCRIPTION OF THE PREFERRED EMBODIMENTS

Figure 1:
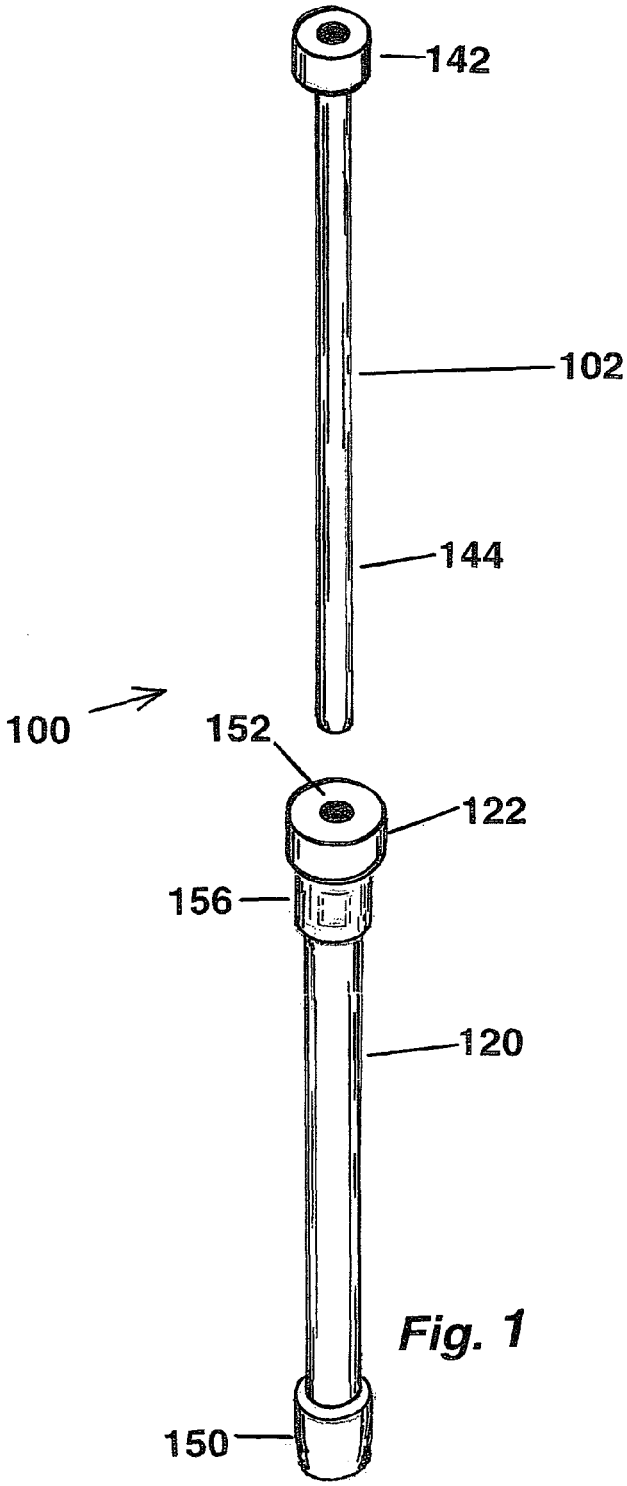
FIG. 1 depicts an exploded perspective view of pellet gun feeder 100.
Figure 2:
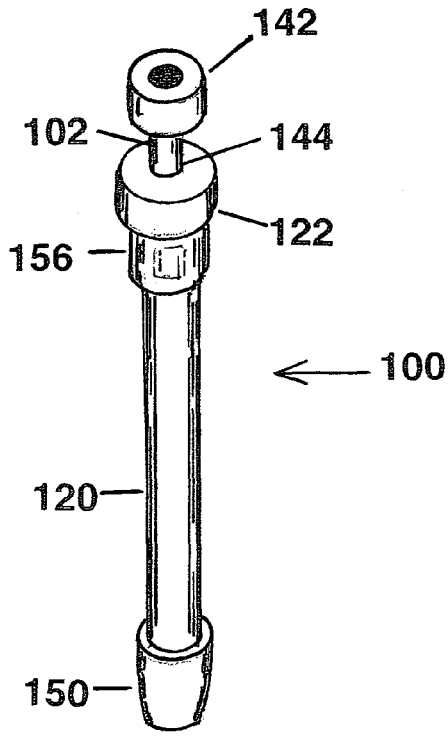
FIG. 2 depicts an assembled perspective view of pellet gun feeder 100.
Figure 3:
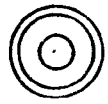
FIG. 3 depicts a top plan view of pellet gun feeder 100.
Figure 4:
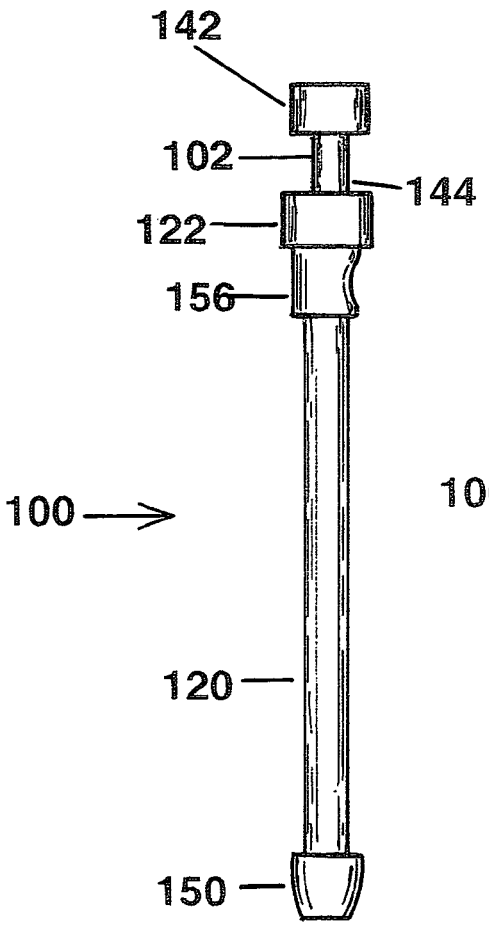
FIG. 4 depicts a right plan view of pellet gun feeder 100.
Figure 5:
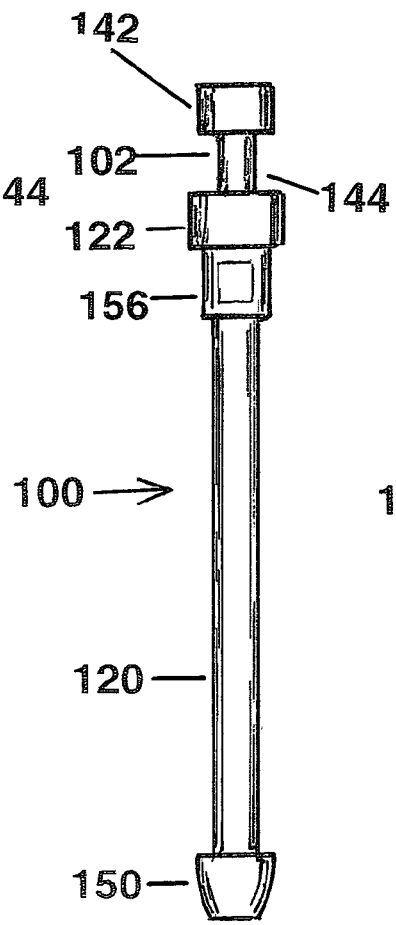
FIG. 5 depicts a front plan view of pellet gun feeder 100.
Figure 6:
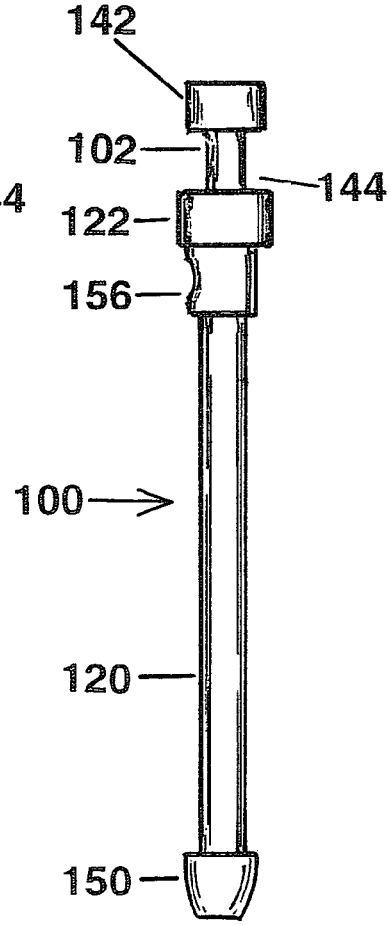
FIG. 6 depicts a left plan view of pellet gun feeder 100.
Figure 7:
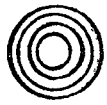
FIG. 7 depicts a bottom plan view of pellet gun feeder 100.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, over, above, below, beneath, rear, and front, may be used with respect to the drawings. These and similar to directional terms are not to be construed to limit the scope of the invention in any manner. The words attach, connect, couple, and similar terms with their inflectional morphemes do not necessarily denote direct or intermediate connections, but may also include connections through mediate elements or devices.

A pellet gun feeder includes a feeder body receiving a feeder rod. The feeder body is a tubular device capable of receiving a line of pellets for a pellet gun therein. At a loading end of the feeder body for the pellet gun feeder is a side slot. Over the side slot is placed a flexible slot tube. Part of the flexible slot tube extends into the hollow interior of the feeder body sufficiently to contact a pellet within the feeder body.

Also on the feeder body is a flexible end tube to partially close the end of the feeder body and contain pellets within the feeder body until placement of a pellet in a pellet gun from the pellet gun feeder is desired. The flexible end tube cooperates with the feeder body to form an expelling end, oppositely disposed from the loading end and the side slot. So pellets are placed one at a time into the feeder tube adjacent to the slot. The flexible slot tube and the flexible end tube combine to act as a holding means and cooperate to hold the pellets in the feeder tube until placing of at least one pellet into a pellet gun is desired.

The feeder rod then slides into the feeder body to contact the pellets therein and drive a pellet into the breech of a pellet gun. The interaction of the feeder rod, feeder body, and the pellets act as a feeding means. The gun may then discharge the pellet at a desired target. The pellet gun feeder then permits the pellet gun to be loaded or reloaded efficiently.

Figure 8:
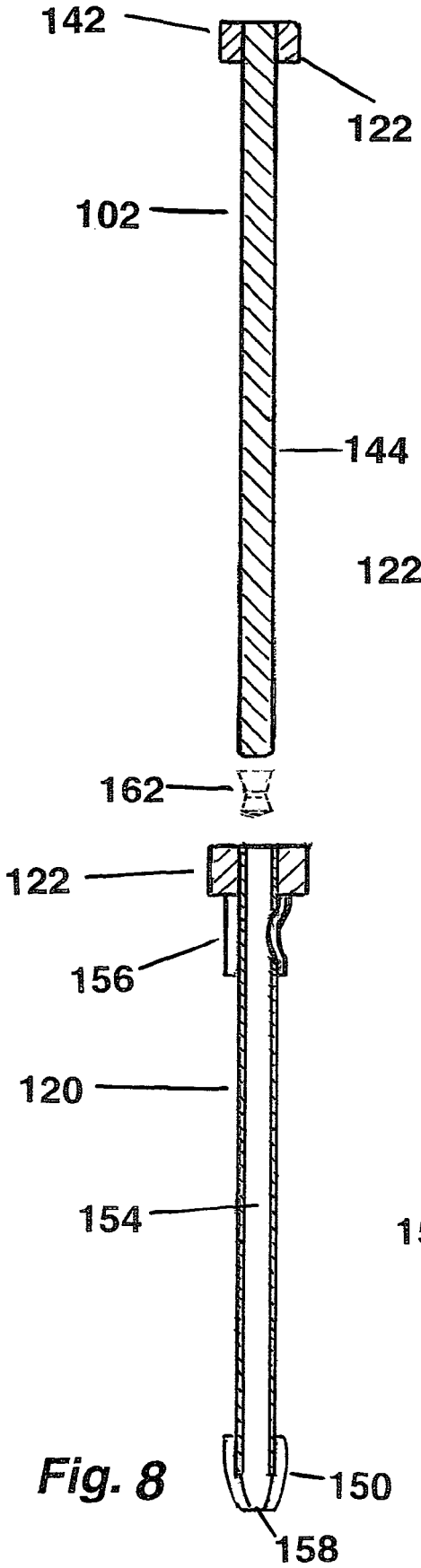
FIG. 8 depicts a right plan, exploded view of pellet gun feeder 100 in cross-section based on FIG. 4.

Taking FIG. 1, FIG. 2, FIG. 3, FIG. 4, FIG. 5, FIG. 6, and FIG. 7 into consideration, the structure of pellet gun feeder 100 can be clearly seen. Pellet gun feeder 100 has feeder rod 102 and feeder body 120. Feeder body 120 has loading aperture 152 which is at the tip of pellet chamber 154, pellet chamber 154 (as seen in FIG. 8) making the feeder body 120 a tubular member. Feeder rod 102 has rod head 142 and rod shaft 144.

Figure 11:
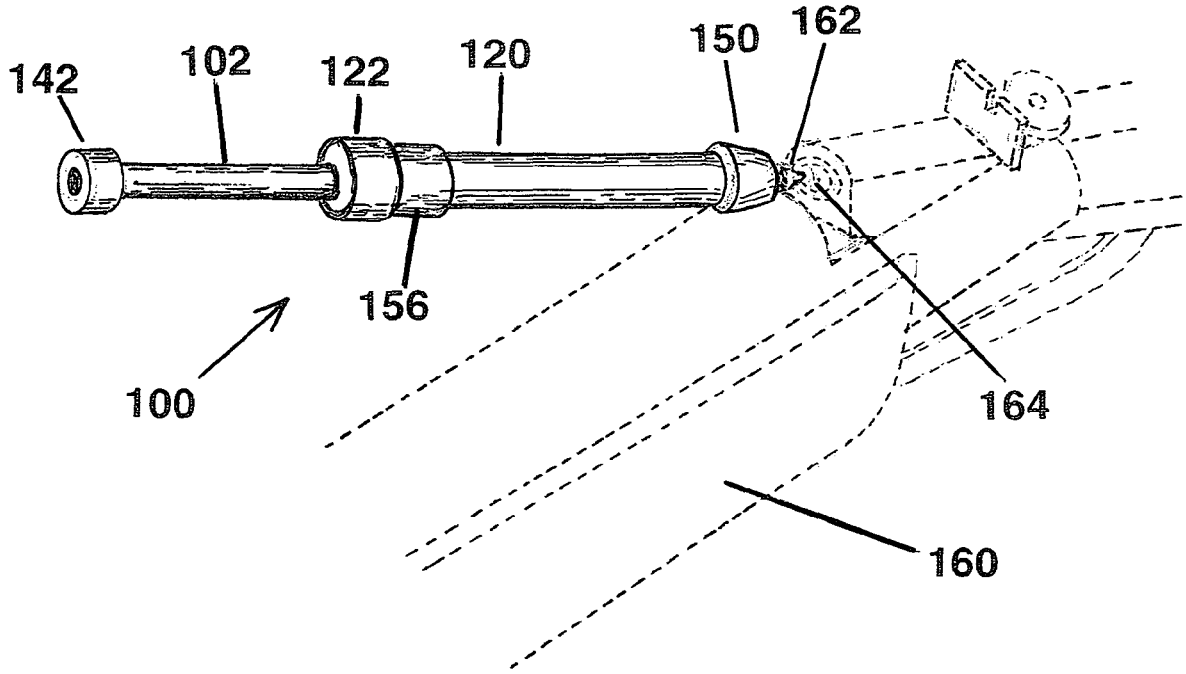
FIG. 11 depicts a perspective view of pellet gun feeder 100 approaching a rifle breech 164.

Rod shaft 144 inserts into loading aperture 152 and may extend the length of pellet chamber 154 (as seen in FIG. 8). Rod head 142 prevents rod shaft 144 from extending too far into pellet chamber 154. Also rod head 142 allows an easy access point for the user to grasp the rod shaft 144 and remove it from pellet chamber 154 to load more pellets 162 (as seen in FIG. 8). Feeder body 120 has feeding aperture 158, through which pellets 162 leave pellet chamber 154 (as seen in FIG. 8) and are loaded into pellet rifle gun 160 (as seen in FIG. 11).

Figure 9:
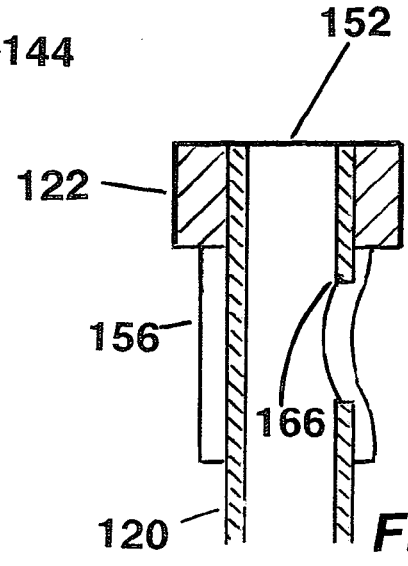
FIG. 9 depicts a side cross-section view of a top portion 122 for feeder body 120 of pellet gun feeder 100 based on FIG. 8.
Figure 10:
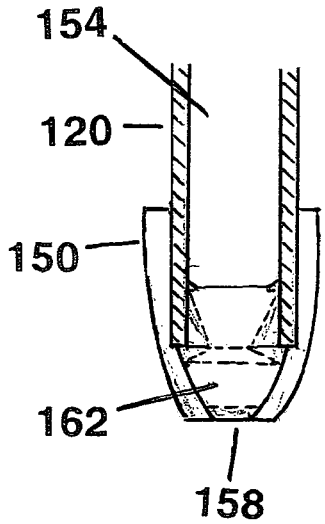
FIG. 10 depicts a side cross-section view of a bottom portion 130 for feeder body 120 of pellet gun feeder 100 based on FIG. 8.

Adding FIG. 8, FIG. 9 and FIG. 10 to the consideration, the loading of at least one pellet 162 and preferably a series of pellets 162 into pellet gun feeder 100 can be clearly seen. The user inserts pellet 162 into pellet chamber 154 and pellet 162 drops or is placed into the pellet chamber 154. The user then inserts rod shaft 144 through loading aperture 152 and into pellet chamber 154. The user grasps rod head 142 to push the rod shaft 144 into the pellet chamber 154. The rod shaft 144 pushes the pellets 162 throughout the length of the pellet chamber 154 until they are stopped by another pellet 162 or the pellet 162 exits the pellet chamber 154 through feeding aperture 158.

The function of flexible end tube or flexible body sleeve 150 can be clearly seen. Pellets 162 are loaded into pellet chamber 154. Flexible body sleeve 150 forms a tip at the end of feeder body 120. Flexible body sleeve 150 holds a single pellet 162 at the tip until feeder rod 102 pushes the pellet 162 into the breech of the pellet rifle gun 160 (as seen in FIG. 11).

Flexible slot sleeve 156 and side slot 166 cooperate to maintain feeder rod 102 and pellets 162 in place within the pellet chamber 154. Top portion 122 of feeder body 120 has side slot 166. Flexible slot sleeve 156 is wrapped around feeder body 120 and covers side slot 166. Flexible slot sleeve 156 is made of any suitable flexible material. Pellets 162 are loaded into pellet chamber 154 with or without the assistance of feeder rod 102. Flexible slot sleeve 156 protrudes through side slot 166 so as to decrease the diameter of pellet chamber 154. This protrusion maintains pellets 162 and feeder rod 102 in pellet chamber 154 so that neither fall out of the pellet chamber 154 during transport.

Clarification of the above discussion is found by considering FIG. 11. With pellet rifle gun 160 and rifle breech 164 depicted in phantom, rifle breech 164 is exposed. Pellet gun feeder 100 approaches rifle breech 164 with pellet 162. Pressure on rod head 142 moves feeder rod 102, which ejects pellet 162 from feeder body 120 and flexible body sleeve 150 into rifle breech 164. Top portion 122 of feeder body 120 receives feeder rod 102, which is held therein by flexible slot sleeve 156, while flexible body sleeve 150 holds pellet 162 in feeder body 120, until the pellet 162 feeds into rifle breech 164.

Turning now to FIG. 12, the flexibility of pellet gun feeder 100 becomes clear. A breech loading pellet gun 170, whether it is a rifle or a pistol, receives pellets 162 from pellet gun feeder 100 into the gun breech 172. More particularly, flexible body sleeve 150 is inserted into rifle breech 164. Then feeder rod 102 is pressed into feeder body 120 by flexible slot sleeve 156 which holds feeder rod 102 and permits pressure on pellet 162, to insert the same into gun breech 172. This method also applies to rifle breech 164 of FIG. 11. Until a pellet 162 passes the flexible slot sleeve 156, the pellet 162 is releasably secured thereby. As feeder rod 102 contacts flexible slot sleeve 156, releasable friction holds feeder rod 102 in a desired position.

In the event that the breech loading pellet gun 170 is a multi shot or repeating gun, more than one of pellet 162 may be inserted therein. In the event that the breech loading pellet gun 170 is a single shot gun, pellet 162 may be inserted therein more efficiently. Pellet gun feeder 100 permits a series of pellets 162 to be loaded into breech loading pellet gun 170 more efficiently, whether it is a pistol, a rifle, a single shot, or multi shot repeater.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A pellet gun feeder for feeding a pellet into a breech of a pellet gun comprising:

a) the pellet gun feeder including a feeder body receiving a feeder rod;

b) the feeder body being adapted to receive at least one pellet of at least one pellet feeding into the breech;

c) the feeder rod being adapted to force the pellet out of the feeder body into the breech;

d) the feeder body including a holding means for holding the at least one pellet in the feeder body;

e) the feeder body including a feeding means for feeding the at least one pellet into the feeder body;

f) the feeder rod cooperating with the holding means and the feeding means;

g) the pellet gun feeder being alignable with the breech of the pellet gun;

h) the feeder body being a tubular device capable of receiving the at least one pellet; and I) the feeder body having a loading end to receive the at least one pellet oppositely disposed from an expelling end to force the same into the breech.

2. The pellet gun feeder of claim 1 further comprising:

a) the feeder body being a tubular member;

b) the loading end including a side slot in one tubular member;

c) a flexible slot sleeve being placed over the side slot is placed; and d) a flexible body sleeve partially closing the expelling end of the feeder body.

3. The pellet gun feeder of claim 2 further comprising:

a) the flexible slot sleeve having an extension into a hollow interior of the feeder body sufficiently to contact at least one member pellet of the at least one pellet within the feeder body and adjacent thereto;

b) the flexible slot sleeve having an extension into a hollow interior of the feeder body sufficiently to contact the feeder rod when a portion of the feeder rod is adjacent to the side slot; and c) the at least one pellet being placeable into the pellet chamber and at least temporarily adjacent to the side slot.

4. The pellet gun feeder of claim 3 further comprising:

a) the flexible slot sleeve and the flexible body sleeve cooperating to hold the pellets in the pellet chamber until placing in a pellet gun is desired; and b) the feeder rod being adapted to drive the at least one pellet into the breech of the pellet gun.

5. The pellet gun feeder of claim 4 further comprising:

a) the feeder rod having a rod head and a rod shaft;

b) the tubular member forming a pellet chamber;

c) the rod shaft being insertable into the loading end and then passing into the pellet chamber;

d) the rod head preventing the rod shaft extension too far into the pellet chamber; and e) the rod head allowing an easy grasp to move the rod shaft and operate the feeder rod.

6. The pellet gun feeder of claim 5 further comprising:

a) the flexible body sleeve being adapted to hold a single pellet of the at least one pellet at the expelling end until the feeder rod pushes the pellet into the breech of the pellet gun; and h) the flexible slot sleeve and the side slot cooperating to maintain the feeder rod and the at least one pellets in place within the pellet chamber.

7. A method of loading a pellet gun comprising:

a) assembling a group of pellets;

b) providing a pellet gun feeder with a feeder rod insertable into a feeder body;

c) placing the group of pellets into the feeder body at a loading end of the feeder body;

d) inserting the feeder rod into the feeder body at the loading end;

e) providing an expelling end for the feeder body oppositely disposed from the loading end;

f) placing the expelling end at or adjacent to a loading breech of the pellet gun;

g) applying pressure on the feeder rod in order to force the feeder rod toward the expelling end; and h) driving at least one pellet from the at least one pellet into the loading breech in order to make the pellet gun a loaded pellet gun.

8. The method of claim 7 further comprising:

a) the feeder body including a holding means for holding the at least one pellet in the feeder body; and b) the feeder body including a feeding means for feeding the at least oriel pellet into the feeder body.

9. The method of claim 8 further comprising:

a) the feeder rod cooperating with the holding means and the feeding means;

b) the pellet gun feeder being alignable with the breech of the pellet gun;

c) the feeder body being a tubular device capable of receiving the a line of the at least one pellet; and d) the feeder body having a loading end to receive the at least one pellet oppositely disposed from an expelling end to force the same in to the breech.

10. The method of claim 9 further comprising a) the feeder body being a tubular member;

b) the loading end including a side slot in the tubular member;

c) a flexible slot sleeve being placed over the side slot is placed; and d) a flexible body sleeve partially closing the expelling end of the feeder body.

11. The method of claim 10 further comprising:

a) the flexible slot sleeve having an extension into a hollow interior of the feeder body sufficiently to contact at least one member pellet of the at least one pellet within the feeder body and adjacent thereto;

b) the flexible slot sleeve having an extension into a hollow interior of the feeder body sufficiently to contact the feeder rod when a portion of the feeder rod is adjacent to the side slot; and c) the at least one pellet being placeable into the pellet chamber and at least temporarily adjacent to the side slot.

12. The method of claim 11 further comprising:

a) the flexible slot sleeve and the flexible body sleeve cooperating to hold the pellets in the pellet chamber until placing in a pellet gun is desired;

b) the feeder rod being adapted to drive the at least one pellet into the breech of the pellet gun;

c) the feeder rod having a rod head and a rod shaft;

d) the tubular member forming a pellet chamber;

e) the rod shaft being insertable into the loading end and then passing into the pellet chamber;

f) the rod head preventing the rod shaft extension too far into the pellet chamber; and g) the rod head allowing an easy grasp to move the rod shaft and operate the feeder rod.

13. The method of claim 12 further comprising:

a) the flexible body sleeve being adapted to hold a single pellet of the at least one pellet at the expelling end until the feeder rod pushes the pellet into the breech of the pellet gun; and b) the flexible slot sleeve and the side slot cooperating to maintain the feeder rod and the at least one pellets in place within the pellet chamber.

14. A pellet gun feeder for feeding a pellet into a breech of a pellet rifle or a pellet pistol comprising:

a) the pellet gun feeder including a feeder body receiving a feeder rod;

b) the feeder body being adapted to receive at least one pellet of the pellet feeding into the breech;

c) the feeder rod being adapted to force the pellet out of the feeder body into the breech;

d) the feeder body including a holding means for holding the at least one pellet in the feeder body;

e) the feeder body including a feeding means for feeding the at least one pellet into the feeder body;

f) the feeder rod cooperating with the holding means and the feeding means;

g) the pellet gun feeder being alignable with the breech of the pellet gun;

h) the feeder body being a tubular device capable of receiving the a line of the at least one pellet; and I) the feeder body having a loading end to receive the at least one pellet oppositely disposed from an expelling cud to force the same in to the breech.

15. The pellet gun feeder of claim 14 further comprising:

a) the feeder body being a tubular member;

b) the loading end including a side slot in the tubular member;

c) a flexible slot sleeve being placed over the side slot is placed; and d) a flexible body sleeve partially closing the expelling end of the feeder body.

16. The pellet gun feeder of claim 15 further comprising:

a) the flexible slot sleeve having an extension into a hollow interior of the feeder body sufficiently to contact at least one member pellet of the at least one pellet within the feeder body and adjacent thereto;

b) the flexible slot sleeve having an extension into a hollow interior of the feeder body sufficiently to contact the feeder rod when a portion of the feeder rod is adjacent to the side slot; and c) the at least one pellet being placeable into the pellet chamber and at least temporarily adjacent to the side slot.

17. The pellet gun feeder of claim 16 further comprising:

a) the flexible slot sleeve and the flexible body sleeve cooperating to hold the pellets in the pellet chamber until placing in a pellet gun is desired; and b) the feeder rod being adapted to drive the at least one pellet into the breech of the pellet gun.

18. The pellet gun feeder of claim 17 further comprising:

a) the feeder rod having a rod head and a rod shaft;

b) the tubular member forming a pellet chamber;

c) the rod shaft being insertable into the loading end and then passing into the pellet chamber;

d) the rod head preventing the rod shaft extension too far into the pellet chamber;

e) the rod head allowing an easy grasp to move the rod shaft and operate the feeder rod;

f) the flexible body sleeve being adapted to hold a single pellet of the at least one pellet at the expelling end until the feeder rod pushes the pellet into the breech of the pellet gun; and g) the flexible slot sleeve and the side slot cooperating to maintain the feeder rod and the at least one pellets in place within the pellet chamber.

* * * * *